United States Patent [19]

Wilson

[11] Patent Number: 4,911,333

[45] Date of Patent: Mar. 27, 1990

[54] BEVERAGE DISPENSING VALVE

[76] Inventor: J. Randall Wilson, P.O. Box 506, Dewey, Okla. 74029

[21] Appl. No.: 188,270

[22] Filed: Apr. 29, 1988

[51] Int. Cl.[4] ..... B67D 5/32

[52] U.S. Cl. ..... 222/153; 222/509; 239/499; 239/583; 251/111; 251/239

[58] Field of Search ..... 239/499, 583, 586, 590.3; 222/153, 509, 518, 510; 251/90, 111, 239, 241, 63.6

[56] References Cited

U.S. PATENT DOCUMENTS

| | | | |
|---|---|---|---|
| 242,523 | 6/1881 | Eske | 251/241 |
| 894,558 | 7/1908 | Wheaton | 239/583 |
| 1,799,074 | 3/1931 | Wallenberg | 251/111 |
| 2,664,314 | 12/1953 | Cissell | 239/583 |
| 2,968,465 | 1/1961 | Flick et al. | 251/63.6 |
| 3,344,732 | 10/1967 | Von Kleydorff et al. | 239/499 |
| 3,741,519 | 6/1973 | Moyer | 251/111 |
| 4,471,938 | 9/1984 | Schwarz | 251/63.6 |

FOREIGN PATENT DOCUMENTS

| | | | |
|---|---|---|---|
| 1220824 | 1/1971 | United Kingdom | 251/239 |

*Primary Examiner*—Andres Kashnikow
*Assistant Examiner*—Michael J. Forman

[57] ABSTRACT

A valve especially adapted for dispensing problematic beverages such as pressurized slurries of frozen or semi-frozen material comprising a valve body, an end cap, an inlet, a valve bore with an outlet, and a valve seat having a specially designed passageway that directs fluid flow toward the walls of the valve bore rather than axially toward the valve outlet.

19 Claims, 2 Drawing Sheets

BEVERAGE DISPENSING VALVE

FIELD OF THE INVENTION

This invention relates to valves especially to valves that are particularly suited for dispensing pressurized slurries of frozen or semifrozen material.

BACKGROUND OF THE INVENTION

The popularity of beverages that are sold as slurries of frozen or semi-frozen material has been well established. Some typical examples include pressurized carbonated beverages sold under such tradenames as the Slurrpy ® brand beverage, the Koolee ® brand beverage, and the Icee ® brand beverage.

In view of the fact that such beverages are pressurized and contain frozen or semi-frozen material the dispensing of such beverages has presented some challenges for those attempting to design a dispensing valve that could be readily used by the general public. The fact that the beverage includes frozen material has in the past sometimes caused freezing up of the valves or valve components. Such freezing up interferes with the opening or complete closing of the valve and thus can cause problems for both the consumer and the merchant. Also the beverage is stored under pressure and when most of the prior art valves are opened there is often a sudden blast of the pressurized slurry. Such sudden blasts can cause one who is not familiar with the dispensing device to have the beverage container knocked out of their control. Obviously such events can lead to spillage that is undesirable to both the consumer and the merchant.

An object of the present invention is to provide a dispensing valve that will allow the general public to dispense such pressurized slurries of frozen or semi-frozen material with less likehood of undesirable waste and mess.

Other aspects, object and advantages of the present invention will become apparent from the following disclosure taken in conjunction with the drawings.

SUMMARY OF THE INVENTION

In accordance with the present invention there is provided a valve that is particularly useful in the dispensing of pressurized slurries of frozen or semi-frozen material. Broadly, the valve comprises a valve body housing containing a longitudinal valve bore. An end closure is secured to one end of the valve body. The open end of the valve bore provides a valve outlet. An inlet port is provided in the valve body to allow for fluid material from a source of supply to flow into the the valve bore. A valve seat means is located across the valve bore at a point between the inlet port and the valve outlet. The valve seat means includes a passageway having an inlet and at least one outlet through which the fluid must flow in order to exit the valve outlet. Each outlet of the valve seat passageway is positioned so as to direct the fluid outwardly to the wall of the valve bore rather than directly downwardly toward the valve outlet. The valve further includes a valve seat closing means and means for actuating the valve seat closing means.

The principal of the invention will be illustrated in the following disclosure by referring to specific preferred embodiments. The specifics mentioned in the test and illustrated in the drawings are intended to exemplify, rather than limit, aspects of the invention as defined in the claims which follow.

DETAILED DESCRIPTION OF PREFERRED EMBODIMENTS

Figure 1:
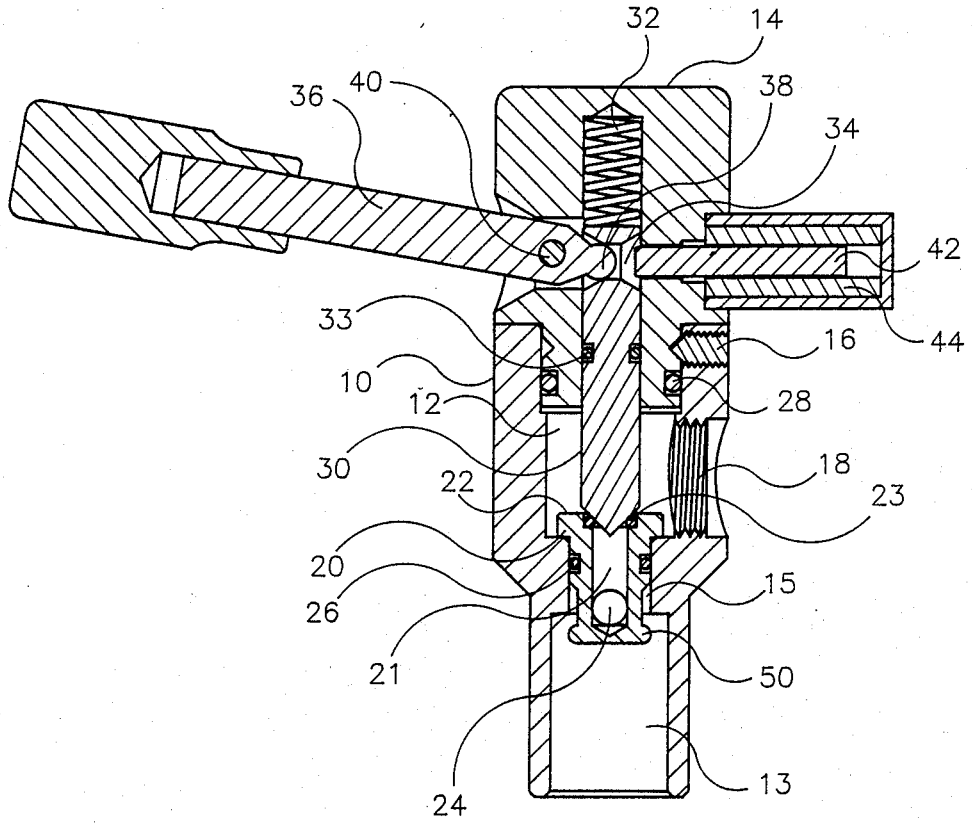
FIG. 1 is a longitudinal sectional view of one preferred valve including the features of the present invention.

A better understanding of the present invention can be obtained by referring to the embodiments shown in the drawings.

The valve of FIG. 1 includes a valve body housing 10 containing a longitudinal valve bore 12. One end of the valve bore is closed by a valve end closure 14 secured to the housing 10 by means of screws 16 which fit into a V-shaped groove on a lower end of the end closure. The housing includes an inlet port 18. In the embodiment illustrated in FIG. 1 this port 18 is a threaded opening adapted to be secured to a conduit means which connects the inventive valve to the source of supply of the beverage.

The valve further includes a valve seat 20 located between the inlet 18 and the outlet 13 of the valve bore. The valve seat 20 includes a passageway having an inlet 22 at the top and a plurality of outlets 24 at the bottom. The inlet 22 in the illustrated embodiment is surrounded by an O-ring 23 which helps protect the valve seat from premature wear.

It will be noted that the outlet 24 is transverse to the main axis of the passageway 21. Generally it is preferred that there be at least two such outlets and that they be opposed to each other.

In the particular embodiment illustrated in FIG. 1, the valve seat 20 is a separate part that is formed to fit securely inside the bore 15 but that is capable of being removed for repair or cleaning. The illustrated embodiment includes on the valve seat 20 an O-ring seal 26 which helps to insure a fluid tight seal between the seat and the valve bore. The valve seat 20 can be made out of any suitable material, however, polymeric materials such as polyethylene or acetal are particulary desirable.

It will also be noted that an O-ring seal 28 is employed on the end closure to insure a fluid tight seal.

The valve of FIG. 1 further includes a valve seat closing means comprising a pointed pin 30 which extends into the end closure. The needle point of the pin 30 rests upon the inlet of the valve seat. The pin is spring biased against the inlet of the valve seat by a spring 32 located above the pin 30 in a cavity in the upper end of the end closure. The pin 30 also has secured around it an O-ring seal 33.

The pin 30 has near its upper end an opening 34 extending through it transverse to its central axis. It should be noted that the outer ends of the opening 34 are cambered. A lever 36 extends through an opening in the side of the end closure. The lever 36 has a spherical end 38 which fits into the cambered portion of the opening 34. The lever 36 is secured to the end closure by pivot pin 40. This arrangement allows one to raise the pin off the valve seat by pushing the lever downward with enough force to overcome the biasing of the spring 32.

Further in the embodiment illustrated in Figure there is a lockout pin 42 which extends into the opening 34 in the pin 30. The lockout pin 42 is actuated by a solenoid 44 which responds to an electrical signal transmitted, for example, in response to some condition of the source of beverage supply. For example, if the supply of gas pressure or beverage were to get too low or if the machine were defrosting, a signal could be generated which would actuate the solenoid which in turn would move pin 42 into the opening 34 of the pin 30 as shown in FIG. 1 thus precluding customers from dispensing any beverage until after the supply problem had been corrected. In the normal operation of the valve when there are no problems with the source of beverage, the pin 42 would be retracted so as not to interfere with the operation of the lever 36.

The valve seat 20 of the valve of FIG. 1 further includes on its lower end a circular baffle plate 50 which extends outward beyond the outlets 24. The objects and benefits of this baffle portion will be described in more detail in regard to the corresponding portion on the valve seat in the valve illustrated in FIG. 2.

Figure 2:
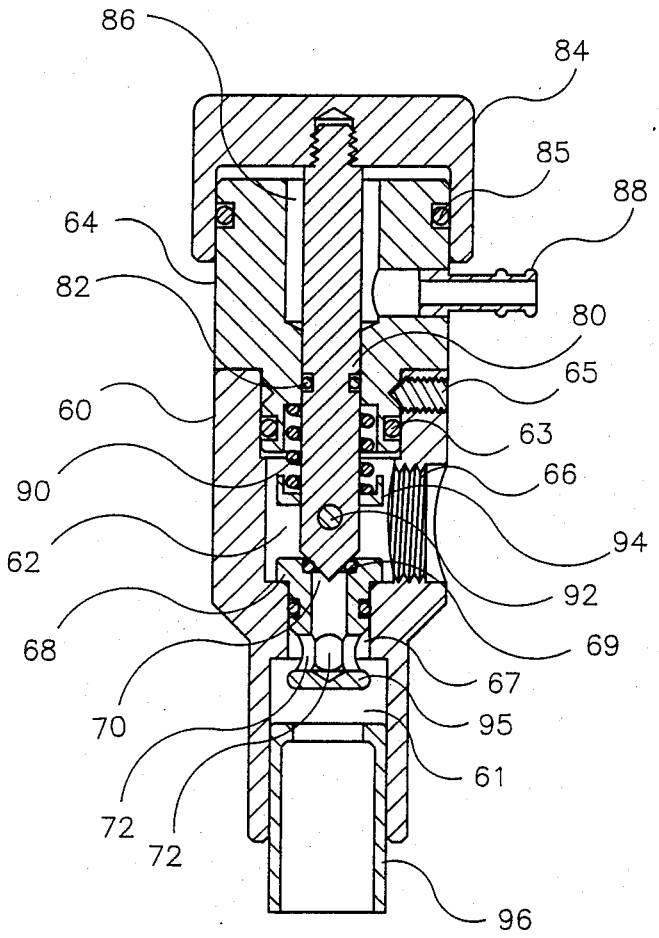
FIG. 2 is a longitudinal sectional view of another preferred valve of the present invention.

FIG. 2 illustrates another embodiment of the present invention in which the valve actuating means is a gas or pneumatic means rather than a manually controlled lever. The valve of FIG. 2 includes a valve body housing 60 containing a longitudinal bore 62. One end of the valve housing is closed by a valve end closure 64 secured by screws 65. An O-ring seal 63 is included on the end closure 64 to assure a fluid tight seal.

The housing 60 includes a threaded inlet port 66 adapted to be secured to a conduit means which connects the inventive valve to a source of supply of the beverage that is to be dispensed.

The valve further includes a valve seat 68 located between the inlet 66 and the open outlet end 61 of the valve bore. The valve seat 68 includes a passageway having an inlet 70 at the top end and outlets 72 at the bottom. In this embodiment the valve seat is a separate part that is press fit into the valve bore 67. The valve seat 68 also has an O-ring 69 surrounding the inlet opening 70.

The valve of FIG. 2 still further includes a pointed pin 80 which extends into the valve bore through a passageway in the end closure 64. An O-ring seal 82 is located in a circular groove on the pin 80, again to assure a fluid-tight seal. The upper end of the pin 80 is secured to a cap 84 which rests upon and surrounds the upper end of the end closure 64. Another O-ring 85 is positioned on an upper portion of the end cap to assure a gas tight seal between the end closure 64 and the cap 84. The end closure 64 further has a passageway 86 surrounding an upper portion of the pin 80. The passageway 86 is connected to an inlet means 88 adapted to be secured to a controllable source of a compressed fluid such as for example gas or compressed air.

The lower end of the pin 80 has a spring 90 positioned about it. A pin 92 secures a retainer 94 around the pin 80 so that spring 90 is under compression which forces the pointed end of the pin 80 into the inlet 70 of the valve seat 68.

In the operation of the valve of FIG. 2, a person desiring to obtain some of the beverage would push a button or switch or the like which is connected to means capable of directing pressurized fluid into the inlet means 88. The pressurized fluid in turn would overcome the strength of the spring 90 and the cap 84 would rise causing the pin 80 to be raised above the valve seat inlet 70 to allow the beverage to flow to the outlet 61 of the valve. After the desired volume of beverage had been dispensed a venting means would allow the fluid pressure in passageway 86 to be vented so that the spring could pull the pin back down on the valve seat 68 and thus effect suspension of beverage flow.

The control of pressurized fluid to the inlet 88 could be such that a consumer would be required to continue pushing a button or other activating device in order to keep the beverage flowing through the valve. Alternatively, the control means could be connected to a timing device such that once the control means was activated the pressurized fluid would continue to be applied to the cap for the period of time necessary for the dispensing of a selected volume of beverage, whereupon the pressure to passageway 86 would be vented. An example of a suitable pneumatically controlled activation means is disclosed in U.S. Pat. No. 4,381,099, the disclosure of which is incorporated herein by reference.

It will be noted that in the valve of FIG. 2 the valve seat outlets 72 are transverse to the axis of the valve bore. The valve seat 68 further includes on its lower end a baffle 95 which extends outwardly beyond the outlet 72. It is further noted that in the valve of FIG. 2, like that of FIG. 1, the valve bore 67 in the area adjacent the outlets of the valve seat is of narrower cross-section than the area adjacent the baffle and below the baffle. This arrangement helps to reduce the force with which the pressurized beverage exits the valve, particularly when the valve is first opened. In the embodiment illustrated in FIG. 2 there is further included in the outlet end of the valve bore a nozzle means 96, the upper end of which contains a flange area which places yet another barrier in the direction of flow of the beverage to still further reduce the force with which the beverage exits the valve.

While the present invention has now been described broadly and by reference to two preferred embodiments it should be readily appreciated that various modifications, changes, and variations can be made in the arrangement, operation, and details of construction of the essential elements without departing from the spirit and scope of the present invention. For example, while manual and pneumatic valve actuating means have been disclosed it should be clear that other arrangements could be made. One example would be the use of an electrically controlled solenoid to move the valve seat closing pin 30.

What is claimed is:

1. A valve especially adapted for use in controlling the dispensing of pressurized slurries of frozen material comprising, a valve body housing having a longitudinal valve bore, end closure means secured to said valve body housing closing one end of the longitudinal bore of said housing, a valve outlet comprising the open end of said valve bore, an inlet port in the valve body adapted to allow fluid material to flow from a source of supply into the bore of said valve body, a valve seat means located across said bore at a point intermediate the inlet port and the valve outlet, said valve seat means comprising a valve seat passageway having an inlet adapted to receive fluid material supplied from said inlet port and at least one outlet means through which fluid material supplied from said inlet port passes into the outlet of said valve, each said outlet means of said passageway being positioned so as to insure that the fluid will be directed transverse to the central axis of the valve bore rather than being directed directly downwardly coaxially with the central axis of the valve bore, a valve seat closing means adapted to close off the inlet of the passageway of said valve seat means, and a valve actuating means which can position said valve seat closing means so as to either permit or prohibit flow of fluid through said valve seat passageway, further characterized by the fact that there is a baffle means located centrally of said valve bore beneath each of the outlet means of said valve seat passageway, said baffle means extending outwardly from the central axis of the valve bore part way across said valve bore beyond each of the outlet means of the valve seat passageway so as to provide additional resistance to the direct axial flow of fluid from the valve seat passageway to the outlet of said valve bore.

2. A valve according to claim 1 wherein there is further included bias means which holds said valve seat closing means against the valve seat until sufficient force is applied to said actuating means to overcome the bias of said bias means.

3. A valve according to claim 1 wherein said baffle means is a generally circular plate positioned at the lower end of said valve seat means.

4. A valve according to claim 3 wherein the outlet end of said bore has upper and lower portions having different cross-sectional dimensions, with upper portion being adjacent the outlet means of the valve seat and with the lower portion being adjacent the baffle, the cross-sectional dimensions of said two portions being such that the distance between the outlet means of said valve seat and the wall of the upper portion of said outlet bore are about the same as the distance between the outer edge of said baffle and the wall of the lower portion of said outlet bore so that fluid can flow from said upper portion to said lower portion around said battle.

5. A valve according to claim 4 wherein there is further included bias means which holds said valve seat closing means against the valve seat until sufficient force is applied to said actuating means to overcome the bias of said bias means.

6. A valve according to claim 5 wherein said actuating means comprises a pnematically controlled means capable of overcoming the bias of said bias means.

7. A valve according to claim 5 wherein said actuating means is a manually operated means capable of overcoming the bias of said bias means.

8. A valve according to claim 7 wherein said valve seat closing means comprises a spring biased pin located centrally above the valve seat, said pin having located on an upper end thereof a cambered indentation and wherein said actuating means comprises a lever having a rounded end fitted into the cambered indentation of said pin, said lever being secured to the valve at a pivot point such that when the lever is pulled downward the rounded end of the lever will raise the pin against the spring bias.

9. A valve according to claim 8 wherein there is further included a lockout means which when activated will preclude said actuating means from being capable of moving said pin.

10. A valve according to claim 9 wherein said spring biased pin has a opening therein and wherein said lock out means comprises a lockout pin capable of being slid into the opening in said spring biased pin through an opening in said valve.

11. A valve according to claim 10 wherein said lockout means includes a lockout activating means which activates the lockout means in response to an electrical signal.

12. A valve according to claim 5 wherein said valve outlet has a tubular nozzle inserted therein, said nozzle extending outside the valve body and having on the upper surface thereof inside the valve outlet a flange containing a circular opening allowing fluid to flow from said valve bore into said nozzle, said opening in said flange being about the same diameter as the diameter of the valve bore in the area adjacent the valve seat outlet means.

13. A valve according to claim 8 wherein said end closure contains an end closure passageway which extends through said end closure wherein an air inlet port is in communication with said closure passageway, wherein said spring biased pin extends upwardly through said end closure, wherein the upper end of said pin is connected to cap positioned above said end closure, said cap having a depending rim which extends downwardly around said end closure, said cap being capable of being moved upwardly relative to said end cap in response to air injected into said closure passageway.

14. A valve according to claim 12 wherein a seal extends around the upper end of said end closure to provide a fluid tight seal between said end closure and the surrounding rim of said cap and wherein a seal extends around said pin at a point in which the pin is within said end closure and below the air inlet port to provide a fluid tight seal between the pin and the end closure.

15. A valve especially adapted for use in controlling the dispensing of pressurized slurries of frozen material comprising, a valve body housing having a longitudinal valve bore extending from one end of the valve body to the other, said valve bore having a central axis, end closure means secured to said valve body housing closing one end of the longitudinal valve bore of said housing, a valve outlet comprising the open end of said valve bore, an inlet port in said valve body adapted to allow fluid material to flow from a source of supply into the bore of said valve body, a valve seat means extending across said valve bore at a point intermediate the inlet port and the valve outlet so that a portion of said valve body extends below said valve seat means, said valve seat means comprising a valve seat passageway having a seat inlet on the upper surface of said valve seat means adapted to receive fluid material supplied from said inlet port and at least one seat outlet means in communication with said seat inlet through which fluid material supplied from said inlet port passes from the seat inlet into the valve outlet, each said seat outlet means of said passageway being positioned so as to insure that the fluid will be directed outwardly toward the surrounding valve body rather than being directed directly downwardly coaxially with the central axis of the valve bore, a valve seat closing means adapted to close off the seat inlet of the passageway of said valve seat means, and a valve actuating means which can position said valve seat closing means so as to either permit or prohibit flow of fluid through said valve seat passageway.

16. A valve especially useful for controlling the dispensing of pressurized slurries of pressurized frozen or semi-frozen material comprising, an elongated valve body having a longitudinal valve bore extending from one end of said valve body to the other, an end closure means secured to said valve body to close one end of the longitudinal bore, a valve outlet comprising the open end of said valve bore, an inlet port in said valve body adapted to allow fluid material to flow from a source of supply into the bore of said valve body, a valve seat means located at a point between the inlet port and the open end of the valve body such that a portion of the valve body extends downwardly below said valve seat means, wherein an upper portion of said valve seat means extends across the valve bore and wherein a lower side portion of the valve seat means is spaced apart from and surrounded by the valve body, said valve seat means including a valve seat passageway comprising a seat inlet on the upper surface of said valve seat means in communication with at least one outlet means opening on the side of a lower portion of the valve seat means that is spaced apart from and surrounded by the valve body, a valve seat closing means adapted to close off the inlet seat of said valve seat, and a valve actuating means which can position said valve seat closing means so as to either permit or prohibit flow of fluid through said valve seat passageway.

17. A valve in accordance with claim 16 wherein there are two seat outlet means opening on opposite sides of said lower portion of said valve seat means

18. A valve especially adapted for use in controlling the dispensing of pressurized slurries of frozen material comprising, a valve body housing having a longitudinal valve bore, end closure means secured to said valve body housing closing one end of the longitudinal bore of said housing, a valve outlet comprising the open end of said valve bore, an inlet port in said valve body adapted to allow fluid material to flow from a source of supply into the bore of said valve body, a valve seat means located across said bore at a point intermediate the inlet port and the valve outlet, said valve seat means comprising a valve seat passageway having an inlet adapted to receive fluid material supplied from said inlet port and at least one outlet means through which fluid material supplied from said inlet port passes into the outlet of the valve, each said outlet means of said passageway being positioned so as to insure that the fluid will be directed transverse to the central axis of the valve bore rather than being directed directly downwardly coaxially with the central axis of the valve bore, a valve seat closing means adapted to close off the inlet of the passageway of said valve seat means, and a valve actuating means which can position said valve seat closing means so as to either permit or prohibit flow of fluid through said valve seat passageway.

19. A device for dispensing pressurized slurries of frozen or semi-frozen material comprising a container containing quantities of a fluid comprising a pressurized slurry of frozen or semi-frozen material and thus acting as a source of supply of said fluid and a valve attached to said container, said valve comprising, a valve body housing having a longitudinal valve bore, end closure means secured to said valve body housing closing one end of the longitudinal bore of said housing, a valve outlet comprising the open end of said valve bore, an inlet port in said valve body adapted to allow said fluid material to flow from said source of supply into the bore of said valve body, a valve seat means located across said bore at a point intermediate the inlet port and the valve outlet, said valve seat means comprising a valve seat passageway having an inlet adapted to receive fluid material supplied from said inlet port and at least one outlet means through which fluid material supplied from said inlet port passes into the outlet of said valve, each said outlet means of said passageway being positioned so as to insure that the fluid will be directed transverse to the central axis of the valve bore rather than being directed directly downwardly coaxially with the central axis of the valve bore, a valve seat closing means adapted to close off the inlet of the passageway of said valve seat means, and a valve actuating means which can position said valve seat closing means so as to either permit or prohibit flow of fluid through said valve seat passageway.

* * * * *